United States Patent [19]

Tippmer

[11] 4,098,583

[45] Jul. 4, 1978

[54] METHOD OF REMOVING ASH COMPONENTS FROM HIGH-ASH COALS

[75] Inventor: Kurt Tippmer, Recklinghausen, Germany

[73] Assignee: Firma Carl Still Recklinghausen, Germany

[21] Appl. No.: 778,473

[22] Filed: Mar. 17, 1977

[30] Foreign Application Priority Data

Mar. 19, 1976 [DE] Fed. Rep. of Germany ..... 2611620

[51] Int. Cl.[2] ..... C10L 9/00; C10L 9/10

[52] U.S. Cl. ..... 44/1 B; 209/11

[58] Field of Search ..... 44/1 R, 1 B, 4; 75/2, 75/6; 201/17; 209/9, 11

[56] References Cited

U.S. PATENT DOCUMENTS

| | | | |
|---|---|---|---|
| 1,925,005 | 8/1933 | Rose et al. | 44/1 B |
| 3,660,054 | 5/1972 | Rieve | 44/1 R |
| 3,998,604 | 12/1976 | Hinkley | 44/1 R |
| 4,058,976 | 11/1977 | Kindl | 44/1 B |

*Primary Examiner*—Carl F. Dees

*Attorney, Agent, or Firm*—McGlew and Tuttle

[57] ABSTRACT

A method of removing ash components from coals, particularly high-ash bituminous and sub-bituminous coals, comprises grinding the coals and suspending the ground coal in an aqueous media to form a raw suspension, fusing the raw suspension and without further additives stirring for 60 to 360 minutes at from 250° C to 350° C and at a pressure of from 50 to 80 atm. Thereupon, the fused suspension is cooled and the pressure thereof is relieved. The aqueous phase containing the dissolved ash components are separated from the coal.

8 Claims, 1 Drawing Figure

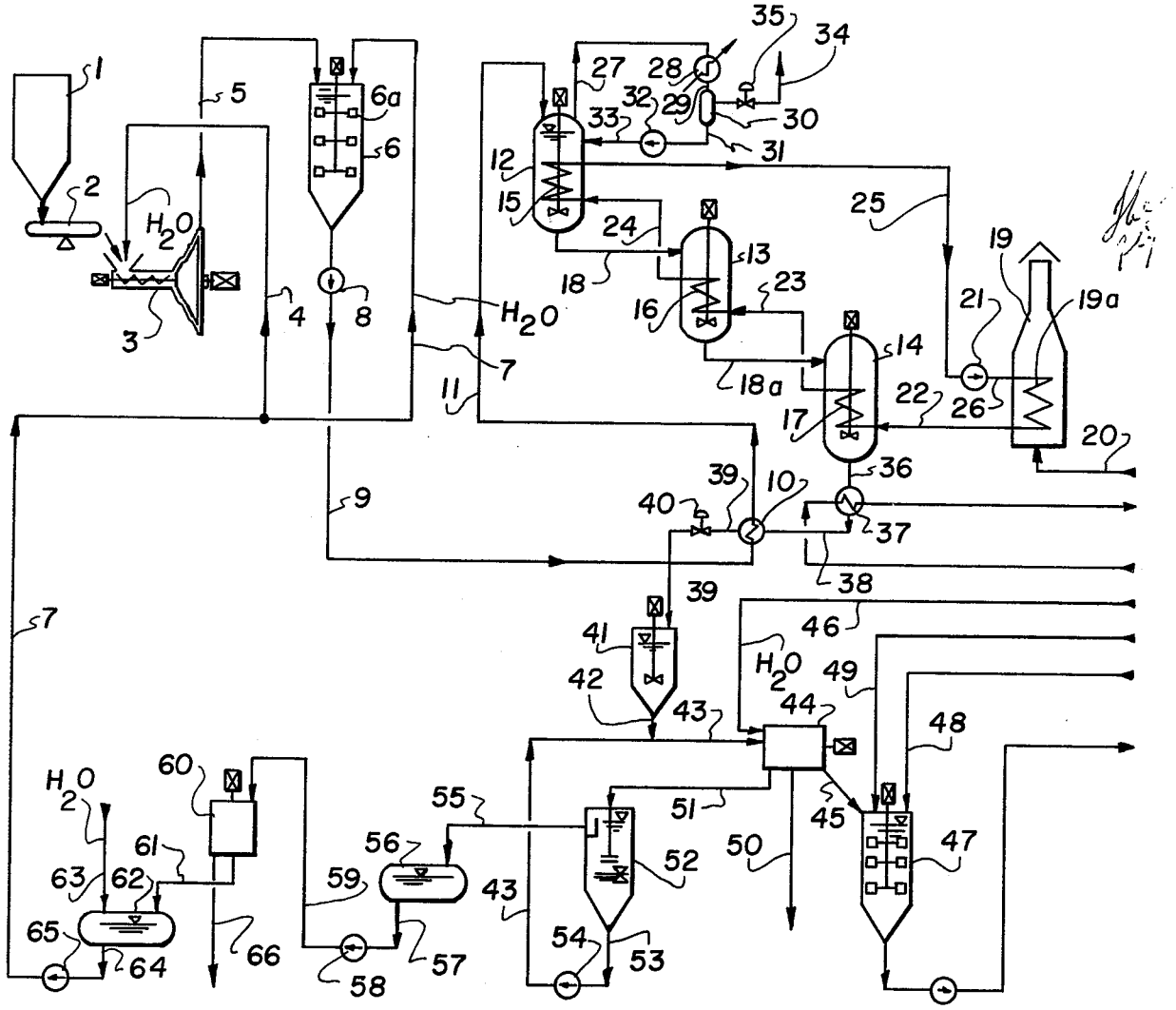
1
2
3
4
5
6
6a
7
8
9
10
11
12
13
14
15
16
17
18
18a
19
19a
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
$H_2O$

METHOD OF REMOVING ASH COMPONENTS FROM HIGH-ASH COALS

This invention relates in general to a method of removing ash from coals and, in particular, to a new and useful method of removing ash components from coals, particularly, high-ash bituminous and sub-bituminous coals.

The present invention relates particularly to a method of removing ash components from coals, particularly high-ash bituminous and sub-bituminous coals, in which the coals are ground, suspended in aqueous media, and the ashes are fused under stirring motion at an elevated temperature and increased pressure and, thereupon, the coals are separated from the aqueous phase.

A method is known from "BIOS FINAL REPORT 522, item 30", in which the fine coal, freed in advance from a part of its ashes in a floatation process, is mixed with 5.6 times the amount of a 2.5 percent sodium hydroxide solution, the suspension is kept for 20 minutes under 100 to 200 atm at 250° C, the liquor is then separated and the coal is washed with water and hydrochloric acid. For this purpose, 140 kg of caustic soda are needed per metric ton of coal.

From U.S. Pat. No. 2,556,496, there is further known an ash removal process in which the coal is extracted at temperatures between 120° C and 130° C, with a mixture of aqueous sodium hydroxide solution and butanol and is subsequently washed with water and hydrochloric acid.

A hydrolysis of coals is known from the reference "Ind. Engng. Chem. 47 (8), page 1586 (1955)", in which fine coals are fused for 24 hours with a 5*n* sodium hydroxide solution at 350° C under an increased pressure of nitrogen as a protective gas.

Since these methods for the most part require large amounts of the relatively expensive caustic soda, with no possibility of recovery, they have not prevailed in the industry.

The present invention is directed to a method of removing ash components from coal which can be carried out at lower expense and with a greater saving of chemicals than the known methods.

In accordance with the present invention, ground coal is fused in a merely aqueous suspension under a stirring motion for 60 to 360 minutes at 250° C to 350° C and under a pressure of 50 to 80 atm. It is then cooled to relieve the pressure, and to separate the aqueous phase containing the dissolved ash components from the coal.

It has been found that under the conditions in accordance with the invention, the hydrolitic decomposition, even of ashes contained in bituminous coals, can be carried out in an economical manner with water alone, without any addition of acids or alkalis.

Depending on the nature and ash content of the treated coal, the conditions under which the ash removal takes place may vary within the above indicated limits. In a preferred variant of the method, which may be used for many varieties of coal, there is provided a coal-to-water ratio of 1 : 1 to 1 : 2, a fusion temperature of 250° C to 280° C, a fusion pressure of 50 to 60 bar, and period of treatment of 180 to 240 min.

In the inventive method, the conversion of the ash components into the aqueous phase separable from the coal substance is supported by the dissociation of the alkali compounds, particularly alkali carbonates, contained in the ash and it is assumed that the ash components from a colloid-disperse phase in the aqueous phase.

The formation of this colloid-disperse phase may be supported by an addition of small quantities of alkali hydroxides or carbonates, for example, NaOH, KOH, $Na_2CO_3$, $K_2CO_3$, to the fusion water. The addition of these substances is advisable in cases where only small quantities of hydrolizable alkali compounds are contained in the coal ashes. The amounts of alkali salts to be added, however, are small. Per metric ton of coal, about 15 to 20 kg of alkali hydroxides or 20 to 30 kg of carbonates are sufficient, and they can be recovered by carbonizing with gases containing carbon dioxide at normal or increased pressure and by circulating the fusion water in accordance with a provided process. In processes of the prior art, on the contrary, 150 to 250 kg of alkali hydroxide and proportionally more carbonate are required per metric ton of coal.

After separating the ash-free coal, the ash components may also be separated from the water used for the ash fusion and the water may be recycled to a new decomposition of ashes in the coal. For purposes of separating the ash components from the water, both chemical and mechanical processes are suitable.

By providing carbonization in the treatment and recycling the fusion water, and if coals with a normal alkali carbonate content are used, the alkali content in the fusion water can be increased, if desired, for the fusion process.

Advantageously, the fusion of the coal ashes may be carried out in a plurality of stages, in series connected reactors, preferably in three stages.

Accordingly, it is an object of the invention to provide an improved method of removing ash components from coals, which comprises grinding the coals and suspending the ground coal in an aqueous media of form a raw suspension, fusing the raw suspension and without further additives while stirring for 60 to 360 minutes at from 250° C to 350° C and at a pressure of from 50 to 80 atm, and, thereupon, cooling the fused suspension and relieving the pressure thereof, separating the aqueous phase containing the dissolved ash components from the coal.

A further object of the invention is to provide a method of removing ash components from coals which is simple to carry out and inexpensive.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

The only FIGURE of the drawing is a diagram showing the method of removing ash components from coals, in accordance with the invention.

The raw coal to be handled has an ash content of 35% and the ash contains, expressed in oxides:

30 % $A_2O_3$, 15 % $Fe_2O_3$, 4 % $K_2O$,
45 % $SIO_2$, 3 % $Ca_O$, 4 % $Na_2O$.

The coal is stored in a bunker 1 and per hour and over a conveyor-type weigher 2, 36.4 metric tons thereof having a water content of 3.0*t* are supplied to a coal mill 3 in which wet crushing takes place under addition of 30.4 $m^3$ of water from a water supply line 4. The screen analysis shows the following grain-size distribution in the coal-water slurry formed:

100 % finer than 400 microns of grain diameter

50 % finer than 44 microns of grain diameter

The coal-water slurry is pumped through a line 5 into a raw suspension bin 6 provided with a stirrer 6a, and through a line 7, 20.6 $m^3$ of water are added. At the outlet of 6, the finished raw suspension is taken off by a pump 8 and delivered, under a pressure of 65 bar, through a line 9 to a heat exchanger 10, where it is heated up to 150° C by the waste water of the fusion suspension leaving the reactor system. A line 11 conveys the suspension to the reactor system.

The reactor system comprises three series-connected stirrer autoclaves 12, 13 and 14, provided with heating coils 15, 16 and 17. In the autoclaves, which are connected to each other by lines 18 and 18a, the coal suspension is decomposed, consecutively in three stages, at temperatures of 250° C to 280° C and a pressure of 60 bar, during a total period of 240 minutes.

The heat for the autoclaves 12, 13 and 14 is supplied by a tube furnace 19 into which fuel is fed through a line 20. Hot oil is circulated by a pump 21 through line 26, pipes 19A, lines 22 to 25, and heating coils 15, 16, and 17 of reactors 12, 13 and 14. Reactor 12 is provided with a gas outlet line 27 to which a cooler 28 and, through a line 29, a condensate separator 30, as well as through a line 31, a return pump 32 and return line 33 to reactor 12 are connected. Gases which develop during the fusion process, for example, $CO_2$ and $H_2S$, are separated in the separator 30 and discharged into the free atmosphere either directly, through a line 34 which includes a pressure relief valve 35 or, after a treatment, while the aqueous condensate is recycled into reactor 12.

The fusion suspension having a temperature of 280° C is drained through a line 36 from reactor 14. Nine metric tons per hour of steam with a pressure of 5 bar are produced in an evaporation cooler 37, and the fusion suspension is cooled down there to 190° C. The suspension is conveyed to heat exchanger 10 through a line 38, and leaves the same with a temperature of 90° C through line 39, after having transferred the greater part of its heat to the raw suspension flowing to the reactor system. The fusion suspension is directed to a collecting bin 41 through a controlling valve 40, which is equipped with a stirrer and through which a total of 24.7 metric tons of coal substance containing 2.9 tons of residual ashes and 62.7 metric tons of the aqueous phase containing 8.7 tons of dispersed ash components pass per hour. The suspension is then directed through lines 42 and 53 to a centrifuge 44, where the coal susbstance is separated from the aqueous phase. The coal substance may additionally be washed with water, which is supplied through a line 46 and drained through a line 50. The 24.7 metric tons of coal substance with a residual ash content of 2.9 tons and 5.5 tons of moisture are discharged through a line 45. This upgraded coal is now available in a stirrer bin 47 for preparing the pure suspension to be gasified.

In stirrer bin 47, 14 $m^3$ of soft water are supplied in addition through a line 48 and through a line 49, a slurry containing 2 metric tons of non-converted carbon substance, 1 ton of ashes, and 3 tons of moisture is added. This slurry has been obtained by settling from washings of the coal pressure gasification. The aqueous phase intended for further treatment leaves centrifuge 44 through a line 51 to a thickener 52.

At the bottom of the thickener 52, equipped with a stirrer, a sludge of carbon and ash components settles, which is drained through a line 53 and recycled, by a pump 54 through line 43 to centrifuge 44. 57.2 metric tons of the aqueous phase loaded with 8.7 tons of dispersed ash components leave thickener 52 through a line 55, flow into an intermediate tank 56 and therefrom through a line 57, pump 58, and line 59 into a decanter 60 for the disperse phase. Through a line 66, 25.2 metric tons of sludge are discharged therefrom, which contains 8.7 tons of ash components separated from the aqueous phase and 16.5 tons of moisture. 32 $m^3$ per hour of clarified water freed from ash components are drawn off through a line 61, and supplied to a tank 62 where they are mixed with 19 $m^3$ of fresh water from a line 63. The mixture of treated and fresh water is drained through a line 64 and recycled by a pump 65 and through line 7 into bin 6 and so into the process.

While a specific embodiment of the invention has been shown and described in detail to illustrate the application of the principles of the invention, it will be understood that the invention may be embodied otherwise without departing from such principals.

The embodiment of the invention in which an exclusive property or privilege is claimed is defined as follows:

1. A method of removing ash components from high-ash bituminous and sub-bituminous coals comprising the steps of grinding the coal to form particles having a grain diameter of less than 400 microns, mixing said ground coal with water to form a raw coal-water slurry, preheating said coal-water slurry to a predetermined temperature, fusing said preheated slurry in an autoclave by heating said preheated slurry to a temperature ranging between 250° C and 350° C at a pressure in the range of 50 to 80 atm for a period ranging between 60 minutes to 360 minutes to form a heated fusion suspension, cooling said fusion suspension by successive stages to a predetermined temperature whereby at least one of said cooling stages is affected by a heat exchange between said fusion suspension and said raw coal-slurry to effect the preheating of said slurry, and separating the coal substance and aqueous phase of said fusion suspension.

2. A method of removing ash components from coals, according to claim 1, wherein the coal is ground and mixed with water in a ratio from 1 : 1 to 1 : 2 and suspended therein to form said raw coal-water slurry, said, fusion taking place at from 250° C to 280° C and at from 50 to 60 atm during a period of from 180 to 240 minutes.

3. A method of removing ash components from coals, according to claim 1, wherein 15 to 20 kg of alkali substances in the form of potassium or sodium hydroxide or 20 to 30 kg of the corresponding carbonates are added to the fusion water per metric ton of coal in order to form the raw coal water slurry

4. A method of removing ash components from coals, according to claim 1, wherein after separating the coal, the fusion water is treated with carbon dioxide.

5. A method of removing ash components from coals, according to claim 1, wherein said fusion of the ashes takes place in a plurality of stages in seriesarranged autoclave vessels.

6. A method of removing ash components from coals, according to claim 5, wherein fusion of the ashes takes place in three successive stages.

7. A method of removing ash components from high-ash bituminous and sub-bituminous coal comprising the steps of grinding coal to a particle having a grain size of less than 400 microns and mixing said ground coal in an aqueous media to from a raw coal-water slurry, fusing said slurry in the absence of further additives while stirring for 60 to 360 minutes and a pressure ranging between 50 to 80 atm; cooling the fused slurry and relieving the pressure thereof, separating the aqueous phase containing the dissolved ash components from the coal, separating the ash components from said aqueous phase to clarify said aqueous phase of its ash components, and recycling said clarified aqueous phase to mix with said ground coal to form a raw-coal slurry.

8. A method of removing ash components from high-ash bituminous and sub-bituminous coals comprising the steps of wet grinding coal into particles having a grain diameter of less than 400 microns, mixing said wet ground coal particles with water to form a raw coal-water slurry, preheating said raw coal-water slurry to a temperature of 150° C, fusing said preheated slurry in successive stages by flowing said slurry through a plurality of serially connected autoclaves, applying heat to the respective autoclaves wherein the flow of slurry through said connected autoclaves is in counterflow relationship to the heat input into said autoclaves whereby said preheated slurry is finally heated in a temperature range of 250° C to 280° C at a pressure in the range of 50 to 60 atm during a period from 180 to 240 minutes, thereafter cooling said fused slurry by evaporation to a temperature of 190° C, further reducing the temperature of said cooled fused slurry by passing said cooled fused slurry in heat exchanged relationship with said raw coal-water slurry to effect the preheating of the raw coal-water slurry, thereafter directing said further cooled fused slurry to a separation for separating the coal substance from the aqueous phase of said fused slurry, separating carbon, sludge and ash components from said aqueous phase and recycling said carbon, sludge and ash components to said separator, and the remaining aqueous phase being thereafter decantered to form a clarified water, and recycling said clarified water to mix with raw coal particles to form a raw coal-water slurry.

* * * * *